US012752159B2

(12) United States Patent
Nishizaka et al.

(10) Patent No.: US 12,752,159 B2
(45) Date of Patent: Oct. 6, 2026

(54) INFORMATION RECORDING APPARATUS, INFORMATION RECORDING METHOD, AND RECORDING MEDIUM RECORDING PROGRAM

(71) Applicant: CASIO COMPUTER CO., LTD., Tokyo (JP)

(72) Inventors: Nobuyoshi Nishizaka, Tokyo (JP); Futoshi Yamamoto, Hanmra (JP); Toshihiro Ohsawa, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 723 days.

(21) Appl. No.: 17/697,009

(22) Filed: Mar. 17, 2022

(65) Prior Publication Data

US 2022/0203170 A1 Jun. 30, 2022

Related U.S. Application Data

(63) Continuation of application No. PCT/JP2020/021752, filed on Jun. 2, 2020.

(30) Foreign Application Priority Data

Sep. 17, 2019 (JP) ..... 2019-168475

(51) Int. Cl.
*A63B 24/00* (2006.01)

(52) U.S. Cl.
CPC .. *A63B 24/0062* (2013.01); *A63B 2024/0009* (2013.01)

(58) Field of Classification Search
CPC ..... A63B 24/0062; A63B 2024/0009; A63B 2024/0071; A63B 24/0075; A63B 69/002;
(Continued)

(56) References Cited

U.S. PATENT DOCUMENTS 6,778,859 B2 * 8/2004 Graindorge ..... A61N 1/3702 607/59
7,254,516 B2 * 8/2007 Case, Jr. ..... A63B 24/0021 702/182

(Continued)

FOREIGN PATENT DOCUMENTS

JP H04369682 A 12/1992
JP 2000249565 A 9/2000

(Continued)

OTHER PUBLICATIONS

International Search Report (ISR) (and English language translation thereof) dated Sep. 8, 2020 issued in International Application No. PCT/JP2020/021752.

(Continued)

*Primary Examiner* — Ankit B Doshi
(74) *Attorney, Agent, or Firm* — Holtz, Holtz & Volek PC

(57) ABSTRACT

An information recording apparatus includes a processor. The processor obtains index information representing a lapse situation after a start of movement. The processor obtains either of a time elapsed from the start of movement and a distance passing from a start point of movement. The processor controls, by using either of the elapsed time and the passing distance, to obtain the index information to, as either of a lapse of time from the start of movement and the distance passing from the start point of movement increases, decrease a frequency of obtainment of the index information at the start of movement or from the start point of movement. The processor records the obtained index information.

13 Claims, 5 Drawing Sheets

(58) Field of Classification Search
CPC .... A63B 2024/0025; A63B 2071/0663; A61B 5/1118; A61B 5/1123; A61B 2503/10
See application file for complete search history.

(56) References Cited

U.S. PATENT DOCUMENTS

| | | | | |
|---|---|---|---|---|
| 8,791,858 | B2 | 7/2014 | Nakagawa | |
| 10,304,347 | B2 * | 5/2019 | Wilson | G06F 3/04883 |
| 10,635,267 | B2 * | 4/2020 | Williams | A61B 5/681 |
| 10,656,695 | B2 * | 5/2020 | Cronin | A61B 5/0205 |
| 10,674,942 | B2 * | 6/2020 | Williams | G06F 3/016 |
| 10,736,543 | B2 * | 8/2020 | Chen | G16H 20/30 |
| 10,838,586 | B2 * | 11/2020 | Ko | H04L 51/224 |
| 10,978,195 | B2 * | 4/2021 | Blahnik | G16H 40/67 |
| 11,039,778 | B2 * | 6/2021 | Soli | G06F 3/015 |
| 11,099,038 | B2 * | 8/2021 | Geboers | G01K 1/022 |
| 11,327,650 | B2 * | 5/2022 | Chen | G06F 3/04886 |
| 2009/0187392 | A1 * | 7/2009 | Riskey | A61B 5/4238 703/11 |
| 2010/0323754 | A1 * | 12/2010 | Nakagawa | G01S 5/017 455/574 |
| 2011/0003665 | A1 * | 1/2011 | Burton | G06F 13/4282 482/8 |
| 2014/0316305 | A1 * | 10/2014 | Venkatraman | G01S 19/49 600/595 |
| 2016/0198978 | A1 * | 7/2016 | Nemoto | A61B 5/7435 600/302 |
| 2017/0135609 | A1 * | 5/2017 | Eckblad | A61B 5/1104 |
| 2018/0078182 | A1 * | 3/2018 | Chen | A61B 5/7435 |
| 2018/0200582 | A1 * | 7/2018 | Thurman | G09B 19/0038 |
| 2018/0200583 | A1 * | 7/2018 | Thurman | A63B 41/08 |
| 2019/0265368 | A1 | 8/2019 | Shimizu et al. | |
| 2020/0046252 | A1 | 2/2020 | Nemoto et al. | |
| 2021/0243698 | A1 | 8/2021 | Yamashita | |

FOREIGN PATENT DOCUMENTS

| | | | |
|---|---|---|---|
| JP | 2010075715 | A | 4/2010 |
| JP | 2011196792 | A | 10/2011 |
| JP | 2015079466 | A | 4/2015 |
| JP | 2017106808 | A | 6/2017 |
| JP | 2017156267 | A | 9/2017 |
| JP | 2019070618 | A | 5/2019 |
| JP | 2019148480 | A | 9/2019 |
| JP | 2019150342 | A | 9/2019 |
| WO | 2008099736 | A1 | 8/2008 |
| WO | 2013146242 | A1 | 10/2013 |
| WO | 2019088295 | A1 | 5/2019 |

OTHER PUBLICATIONS

Japanese Office Action (and English language translation thereof) dated Apr. 6, 2021 issued in Japanese Application No. 2019-168475.
Written Opinion dated Sep. 8, 2020 issued in International Application No. PCT/JP2020/021752.
Extended European Search Report (EESR) dated Sep. 30, 2022, issued in counterpart European Application No. 20865779.1.
Chinese Office Action (and an English language translation thereof) dated Feb. 18, 2023, issued in counterpart Chinese Application No. 202080063567.7.
English Translation of an International Preliminary Report on Patentability and Written Opinion dated Mar. 31, 2022, issued in International Application No. PCT/JP2020/021752.
Japanese Office Action (and an English language translation thereof) dated Dec. 3, 2024, issued in counterpart Japanese Application No. 2023-125658.
Japanese Office Action (and an English language translation thereof) dated Aug. 13, 2024, issued in counterpart Japanese Application No. 2023-125658.

* cited by examiner

| Elapsed time t | Time interval | Maximum value of elapsed time | Maximum data number of information |
|---|---|---|---|
| $0 < t \leqq 1h$ | 1sec | 40 | 3600 |
| $1h < t \leqq 2h$ | 10sec | 400 | 360 |
| $2h < t \leqq 3h$ | 20sec | 800 | 180 |
| $3h < t \leqq 4h$ | 30sec | 1200 | 120 |

INFORMATION RECORDING APPARATUS, INFORMATION RECORDING METHOD, AND RECORDING MEDIUM RECORDING PROGRAM

CROSS-REFERENCE TO RELATED APPLICATIONS

This application is a Continuation Application of PCT Application No. PCT/JP2020/021752, filed Jun. 2, 2020 and based upon and claiming the benefit of priority from the prior Japanese Patent Application No. 2019-168475, filed Sep. 17, 2019, the entire contents of both of which are incorporated herein by reference.

FIELD

The present invention relates to an information recording apparatus, information recording method, and recording medium recording a program suitable for recording information obtained by running or the like.

BACKGROUND

There has been proposed a technique for reducing the storage capacity of a memory that stores running trajectory information in a navigation device (see, for example, Jpn. Pat. Appln. KOKAI Publication No. 04-369682). The technique described in Jpn. Pat. Appln. KOKAI Publication No. 04-369682 proposes a method of, if the storage capacity of a memory becomes full, thinning information stored in the memory and storing again the information. In Jpn. Pat. Appln. KOKAI Publication No. 04-369682, the power consumption of the device is not considered.

SUMMARY

An information recording apparatus according to an aspect includes a processor configured to: obtain index information representing a lapse situation after a start of movement; obtain either of a time elapsed from the start of movement and a distance passing from a start point of movement; control, by using either of the elapsed time and the passing distance, to obtain the index information to, as either of a lapse of time from the start of movement and the distance passing from the start point of movement increases, decrease a frequency of obtainment of the index information at the start of movement or from the start point of movement; and record the obtained index information.

DETAILED DESCRIPTION

An embodiment when the present invention is applied to a wearable terminal used for recreation and sports accompanied by movement such as running and cycling will be described in detail with reference to the accompanying drawings.

In the following description, a wearable terminal 10 attached to, for example, the waist of a user at the time of an action such as running, cycling, or trekking records various data during the action.

Arrangement According to Embodiment

Figure 1:
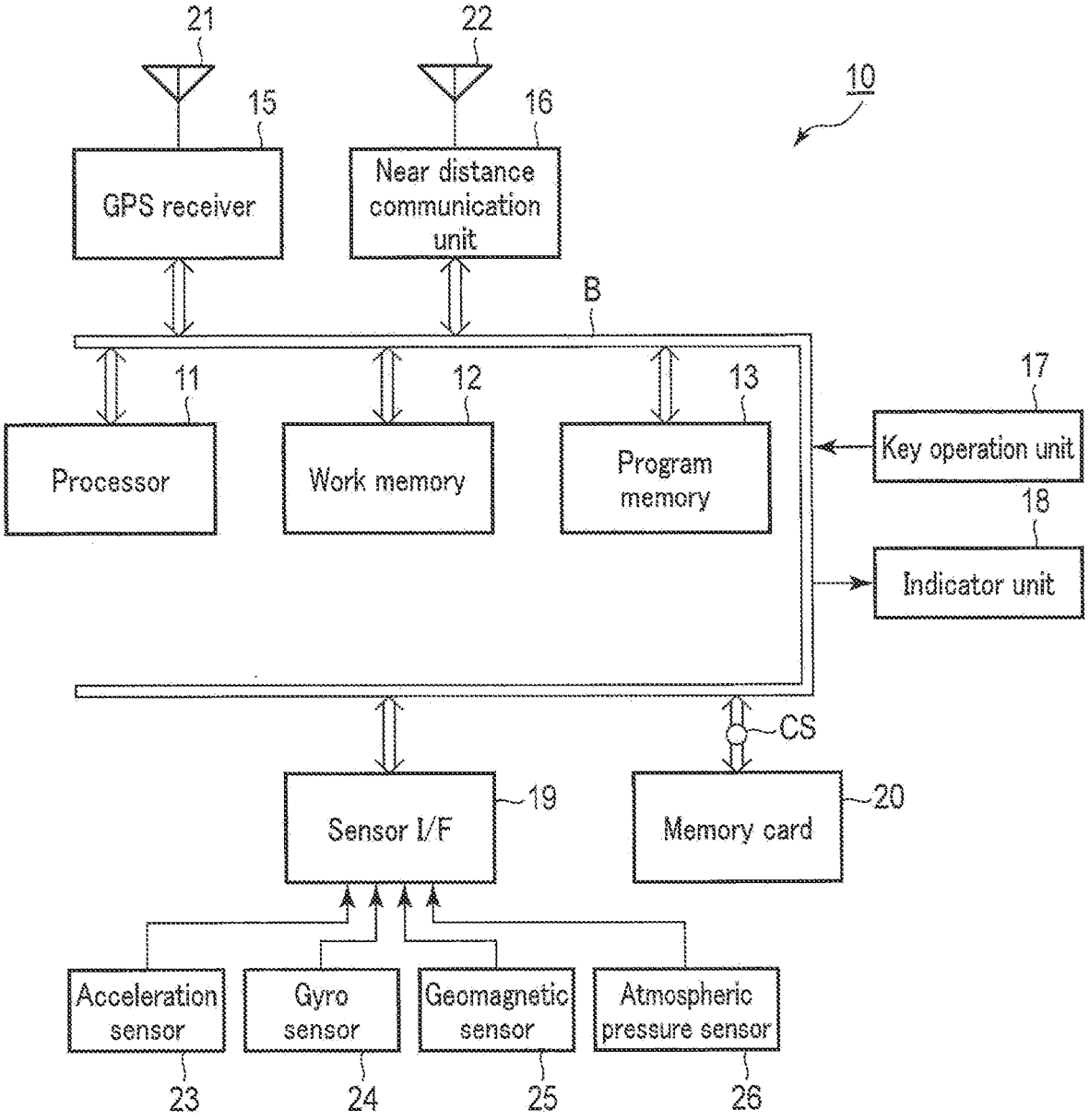
FIG. 1 is a block diagram showing the functional arrangement of the electronic circuit of a wearable terminal according to an embodiment of the present invention.

FIG. 1 is a block diagram showing the functional arrangement of the electronic circuit of the wearable terminal 10. In FIG. 1, the wearable terminal 10 operates mainly using a processor 11, a work memory 12, and a program memory 13.

The processor 11 totally controls operations and the like (to be described later) by reading out operation programs, various fixed data, and the like stored in the program memory 13 formed from a nonvolatile memory such as a flash memory, expanding and holding the readout operation programs, various fixed data, and the like in the work memory 12 formed from an SRAM, and then sequentially executing the operation programs.

A GPS (Global Positioning System) receiver 15, a near distance communication unit 16, a key operation unit 17, an indicator unit 18, a sensor interface (I/F) 19, and a memory card 20 are connected via a bus B to the processor 11, the work memory 12, and the program memory 13.

The GPS receiver 15 receives electric waves incoming from a plurality of GPS satellites (not shown) using a GPS antenna 21, and calculates a current time and the absolute three-dimensional coordinate positions (latitude/longitude/altitude) of a current position.

Note that the GPS receiver 15 may be one that can cope with a satellite positioning system other than GPS, such as GLONASS (Global Navigation Satellite System) or QZSS (Quasi-Zenith Satellite System) serving as a Japanese regional navigation satellite system, receive electric waves incoming from these satellites, and calculate a current time and the three-dimensional coordinate positions of a current position at higher precision. In this case, the following description of a positioning operation by the GPS receiver 15 also includes execution of a positioning operation by the satellite positioning system other than GPS.

The near distance communication unit 16 is a circuit that performs data communication with a portable information terminal such as a smartphone with a low power consumption using an antenna 22 by a Bluetooth® LE (Low Energy) near distance communication technique.

An application program dedicated to the wearable terminal 10 is installed in advance in the portable information terminal (not shown). By executing the application program, the portable information terminal can select and set various parameters necessary to record trajectory information in the state of pairing with the wearable terminal 10 before an actual operation of the wearable terminal 10. After the operation of the wearable terminal 10, the portable information terminal can read out, transfer, and set trajectory information saved in the wearable terminal 10.

The key operation unit 17 accepts operations to keys including a power key provided in the wearable terminal 10, and transmits operation key signals to the processor 11.

The indicator unit 18 includes, for example, a red LED (Light Emitting Diode) and its driver, and is blinked/extinguished in accordance with an ON/OFF instruction from the wearable terminal 10.

The sensor interface 19 is connected to, for example, an acceleration sensor 23, a gyro sensor 24, a geomagnetic sensor 25, and an atmospheric pressure sensor 26. The sensor interface 19 accepts information of an external force applied to the wearable terminal 10 as a detection output of each sensor. If necessary, the sensor interface 19 digitizes the accepted detection output to send it to the processor 11.

The acceleration sensor 23 detects accelerations along the three perpendicular axes, thereby detecting the posture (including the gravitational acceleration direction) of the user wearing the wearable terminal 10, and the direction of an applied external force.

The gyro sensor 24 is formed from, for example, a vibration gyroscope. The gyro sensor 24 detects angular velocities along the three perpendicular axes, thereby detecting the degree of a change of the posture of the wearable terminal 10.

The geomagnetic sensor 25 is formed from, for example, a magnetoresistance effect element (MR sensor). The geomagnetic sensor 25 detects geomagnetisms along the three perpendicular axes, thereby detecting an azimuth in which the wearable terminal 10 moves.

A combination of detection outputs of the acceleration sensor 23, gyro sensor 24, and geomagnetic sensor 25 can yield an action trajectory considering an azimuth based on autonomous navigation in the three-dimensional space even under an environment, such as inside a tunnel, between buildings, or indoors, in which the absolute value of a current position cannot be detected by the GPS receiver 15 and the GPS antenna 21.

The atmospheric pressure sensor 26 detects an atmospheric pressure, thereby detecting a change of the atmospheric pressure state. If GPS positioning fails, the atmospheric pressure sensor 26 can be used to estimate an altitude in combination with altitude information obtained from an output of the GPS receiver 15. Both GPS positioning and a detection output of the atmospheric pressure sensor 26 can be used to increase the precision of particularly altitude information in information of relative action trajectories obtained by the acceleration sensor 23, gyro sensor 24, and geomagnetic sensor 25.

The memory card 20 is provided detachably from the wearable terminal 10 via a card slot CS. The memory card 20 is mounted in the wearable terminal 10 in order to record various data detected by the wearable terminal 10.

First Operation Example

The first operation example of the embodiment will be described with reference to FIGS. 2, 3, 4, 5, and 6.

In this operation example, a case in which the wearable terminal 10 is used as an information recording apparatus that records various kinds of information during running will be explained. For example, trajectory information and sensor data of each sensor for a maximum of four hours after the start of running are recorded. The trajectory information and sensor data of each sensor will be generically named "information". The frequency of recording is every one [sec] until one hour after the start, every 10 [sec] until two hours after one hour, every 20 [sec] until three hours after two hours, and every 30 [sec] until four hours after three hours.

Assume that before the start of running, various parameters necessary to record information by the wearable terminal 10 are selected via the antenna 22 and the near distance communication unit 16 by the portable information terminal (not shown) such as a smartphone in which the application program dedicated to the wearable terminal 10 is installed in advance.

In the embodiment, as for obtaining a current position, the absolute value of a current position is obtained by the GPS receiver 15 and the GPS antenna 21. As parallel processing, detection outputs of the acceleration sensor 23, gyro sensor 24, geomagnetic sensor 25, and atmospheric pressure sensor 26 are combined to keep obtaining an action trajectory considering the azimuth based on autonomous navigation in the three-dimensional space even in a situation in which the absolute value of a current position cannot be detected by the GPS receiver 15 and the GPS antenna 21. The processor 11 calculates the current position by properly combining the absolute value of the current position obtained by the GPS receiver 15 and the GPS antenna 21, and position information relatively obtained from a previous current position obtained from detection outputs of the acceleration sensor 23, gyro sensor 24, geomagnetic sensor 25, and atmospheric pressure sensor 26.

Figure 2:
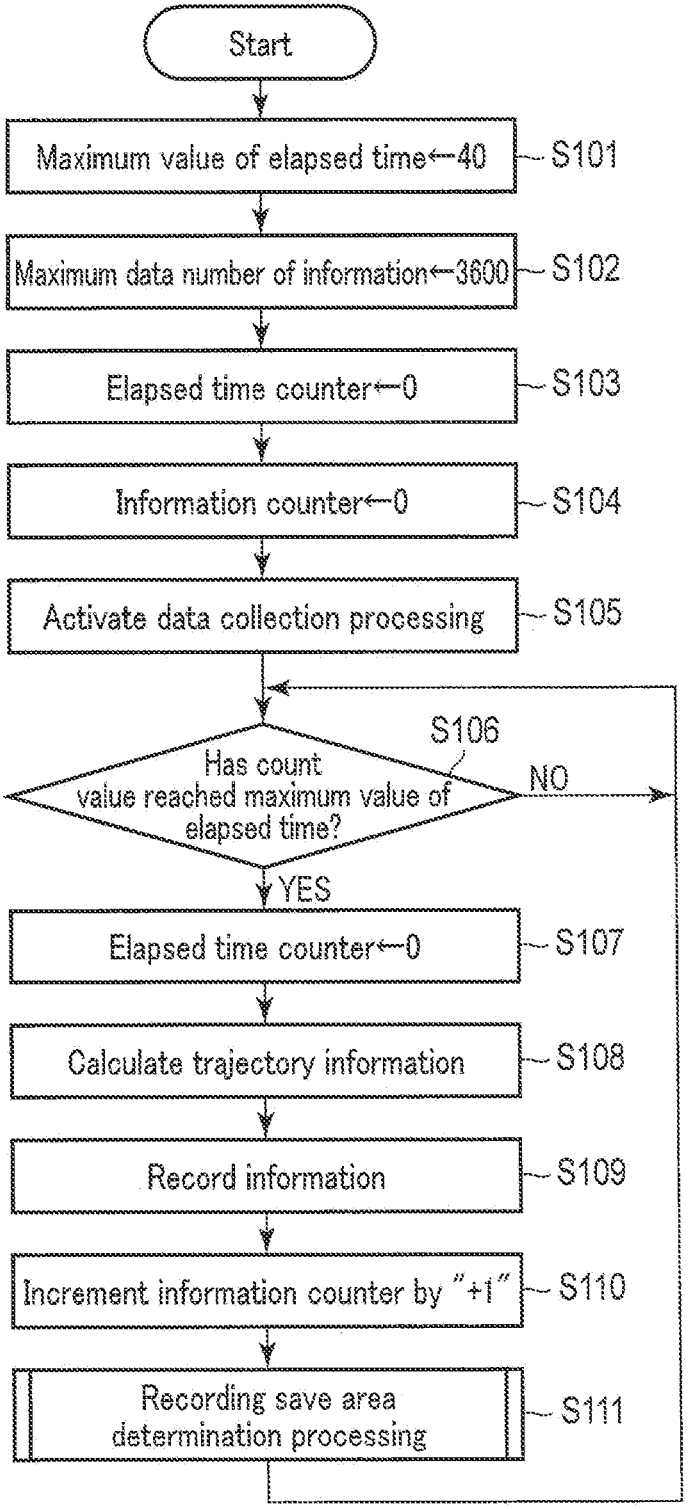
FIG. 2 is a flowchart showing the contents of processing after the start of recording trajectory information according to the first operation example of the embodiment of the present invention.

FIG. 2 is a flowchart showing the contents of processing executed by the processor 11 after the start of recording information in accordance with an operation to the power key of the key operation unit 17. At the beginning of the processing, the processor 11 sets an initial value "40" as the maximum value of the elapsed time that is an index of the elapsed time (step S101). For example, a detection output of each sensor is obtained 40 times during 1 [sec], and the maximum value of the elapsed time is set to determine the lapse of time based on the number of times.

Figures 5, 6:
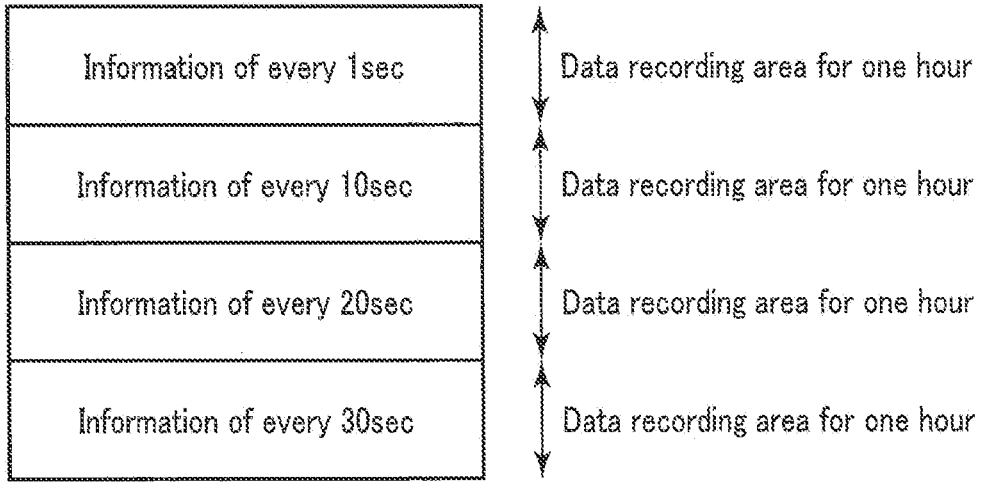
FIG. 5 is a table showing the relationship between the time interval, the maximum value of the elapsed time, and the maximum data number of trajectory information in accordance with the elapsed time according to the first operation example of the embodiment of the present invention.
FIG. 6 is a view exemplifying trajectory information save areas according to the first operation example of the embodiment of the present invention.

FIG. 5 is a table showing the relationship between the time interval of recording, the maximum value of the elapsed time for determining it, and the maximum data number of information to be recorded in accordance with the elapsed time (t). These parameters are stored in advance in the program memory 13 as fixed data corresponding to the operation program.

The processor 11 sets an initial value "3600" as the maximum data number of information to be recorded (step S102).

Further, the processor 11 clears an elapsed time counter that counts a time elapsed after the start of recording, and resets the count value to "0" (step S103).

Subsequently, the processor 11 clears an information counter that counts the recording number of information, and resets the count value to "0" (step S104).

By the above processing, the initial setting is completed, and the processor 11 activates data collection processing of collecting a current position obtained by the GPS receiver 15 and the GPS antenna 21, and detection outputs of various sensors 23 to 26 by the sensor interface 19 (step S105). The sensor interface 19 executes interval timer processing and after the activation, collects sensor data together with a count operation by the elapsed time counter periodically (40 times/sec).

Figure 3:
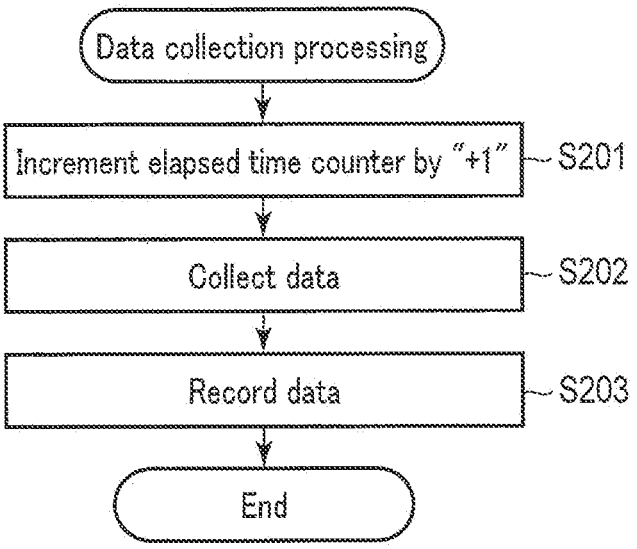
FIG. 3 is a flowchart showing the contents of sensor data collection processing according to the first operation example of the embodiment of the present invention.

FIG. 3 is a flowchart showing the contents of data collection processing of a current position and sensor data that is continuously executed by the GPS receiver 15, the GPS antenna 21, the sensor interface 19 under the control of the processor 11. At the beginning of the processing, the processor 11 increments the count value of the elapsed time counter by "+1" (step S201). After that, the sensor interface 19 collects a current position obtained by the GPS receiver 15 and the GPS antenna 21, and sensor data serving as detection outputs of the acceleration sensor 23, gyro sensor 24, geomagnetic sensor 25, and atmospheric pressure sensor 26 (step S202).

The sensor interface 19 sends the collected current position and sensor data to the processor 11. The processor 11 records the current position and sensor data on the memory card 20 (step S203). By the above processing, one data collection processing ends. As described above, this data collection processing is executed periodically (40 times/sec).

Referring back to the processing in FIG. 2, the processor 11 waits for the timing of save by repetitively determining (step S106) whether the count value of the elapsed time counter has reached a maximum value (for example, "40" for the first one hour) set at that time.

If the processor 11 determines in step S106 that the count value of the elapsed time counter has reached the maximum value set at that time (YES in step S106), it clears the elapsed time counter and resets the count value to "0" (step S107).

Then, the processor 11 calculates relative position information from previously obtained position information of the action trajectory using sensor data corresponding in number to the maximum value of the elapsed time that have been saved so far. By using the calculated relative position information and information of the absolute value of the current position obtained by the GPS antenna 21 and the GPS receiver 15, the processor 11 calculates, as trajectory information, information of the moved wearable terminal 10 up to the current position (step S108).

The processor 11 records again, as information, the calculated trajectory information and the sensor data on the memory card 20 (step S109).

FIG. 6 is a view exemplifying recording areas of information for a total of four hours that are ensured in the memory card 20 by the processor 11. As shown in FIG. 6, information obtained every one sec is saved in a recording area for the first one hour, information obtained every 10 sec is saved in a recording area for the next one hour, information obtained every 20 sec is saved in a recording area for the second next one hour, and information obtained every 30 sec is saved in a recording area for the last one hour. In FIG. 6, these recording areas have uniform capacities to facilitate the description. However, in the actual memory card 20, letting "1" be the capacity of the recording area for the first one hour, the capacities of the subsequent recording areas each for one hour are "1/10", "1/20", and "1/30", respectively.

After recording the information on the memory card 20, the processor 11 increments the count value of the information counter by "+1" (step S110).

After updating the information counter, the processor 11 executes processing of determining whether the recording area of information needs to be changed (step S111).

Figure 4:
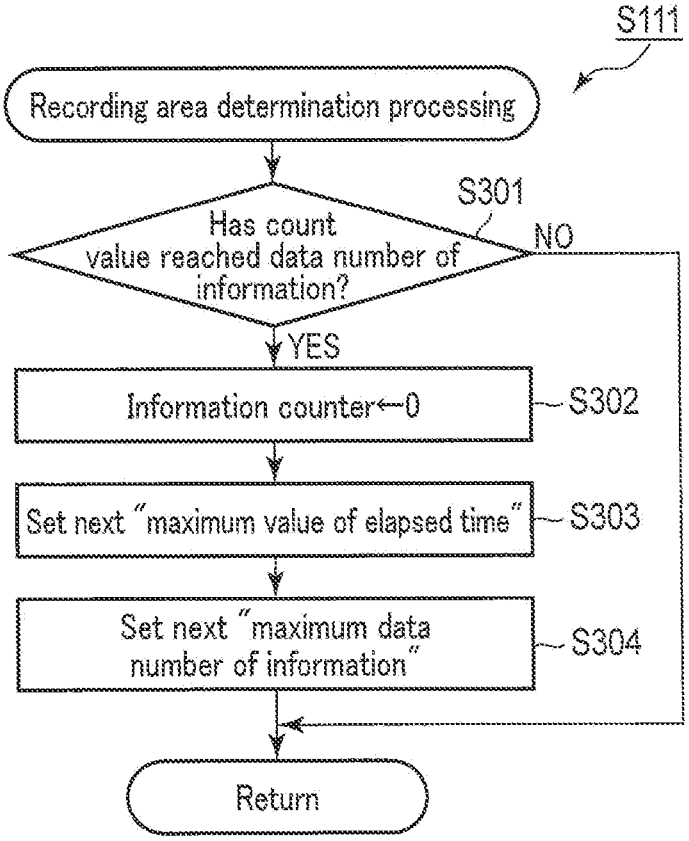
FIG. 4 is a flowchart of a subroutine showing details of recording area determination processing according to the first operation example of the embodiment of the present invention.

FIG. 4 is a flowchart of a subroutine showing details of the recording area determination processing. At the beginning of the processing, the processor 11 determines, based on whether the count value of the updated information counter has reached the maximum data number of information set at that time, whether recording of information for one hour at equal time intervals has ended and the area allocated in the memory card 20 to record information needs to be changed (step S301).

If the processor 11 determines that the count value of the information counter has not reached the maximum data number of information (NO in step S301), recording of information for one hour at equal time intervals has not ended, and the recording area of information in the memory card 20 need not be changed. The processor 11 ends the processing in FIG. 4, and in the processing of FIG. 2, returns to the processing from step S106 in wait for the next information recording timing.

If the processor 11 determines in step S301 that the count value of the information counter has reached the maximum data number of information (YES in step S301), it clears the count value of the information counter and resets the count value to "0" (step S302).

Further, the processor 11 sets the next maximum value of the elapsed time in wait for recording of information for the next one hour, as shown in FIG. 5 (step S303). The processor 11 sets the next maximum data number of information (step S304).

By the above processing, the processor 11 ends the processing after the recording of information for one hour, ends the processing in FIG. 4, and in the processing of FIG. 2, returns to the processing from step S106 in wait for the next information recording timing.

If the user operates the power key of the key operation unit 17, the processing in FIG. 2 ends. If the portable information terminal such as a smartphone in which the application program dedicated to the wearable terminal 10 is installed in advance comes close to the wearable terminal 10, the wearable terminal 10 automatically executes pairing processing through the near distance communication unit 16 and the antenna 22, collects pieces of information recorded on the memory card 20, and automatically transfers them to the portable information terminal at once.

As described above, according to the first operation example of the embodiment, for example, the frequency of obtainment is set so that the time interval becomes longer every time, for example, one hour elapses after the start of the operation. Then, information accompanying movement is obtained and recorded. Even if a capacity-limited power supply is used, information the user wants can be properly recorded while reducing the power consumption.

In this operation example, the frequency at which a current position is obtained is decreased stepwise by setting the time interval to every one sec, every 10 sec, every 20 sec, and every 30 sec every time one hour elapses after the start of the operation. Trajectory information for a maximum of four hours is obtained and recorded. However, the present invention is not limited to this, and the time width at which the frequency of obtainment is changed, the frequency of obtainment, the maximum recordable time, and the like can be arbitrarily changed by pre-setting of the application program.

Second Operation Example

The second operation example of the embodiment will be described with reference to FIGS. 7 and 8.

In this operation example, a case in which the wearable terminal 10 is used as an information recording apparatus that records various kinds of information during running will be explained. For example, the wearable terminal 10 records pieces of information at times of passing a plurality of distance points set in advance till the goal after the start of running.

Figure 7:
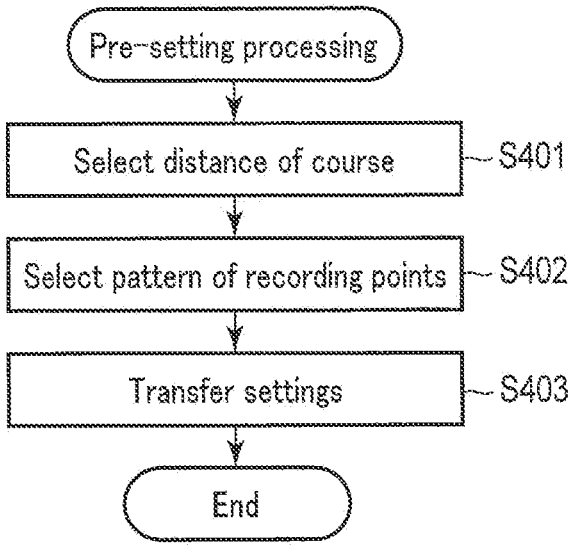
FIG. 7 is a flowchart showing the contents of pre-setting processing according to the second operation example of the embodiment of the present invention.

FIG. 7 is a flowchart showing the contents of pre-setting processing executed by a portable information terminal such as a smartphone in which the application program dedicated to the wearable terminal 10 is installed in advance.

At the beginning, the portable information terminal selects the distance of an entire course of running (step S401). Selectable candidates of the distance of the course are, for example, 5 km, 10 km, a quarter marathon (10.54875 km), a half marathon (21.0975 km), 30 km, a full marathon (42.196 km), and ultra marathons (50 km, 100 km, and 100 miles (160.9344 km)).

After selecting the distance of the course, the portable information terminal selects a pattern of recording points of the distance for obtaining information after the start of running (step S402). As for the pattern of recording points of the distance, a plurality of patterns are prepared in advance for each course distance candidate, and the portable information terminal can select one of pattern candidates in correspondence with the selected course distance.

For example, if a full marathon (42.196 km) is selected as the course distance in step S401, the portable information terminal can select in step S402, for example, either of the following two patterns:

First Pattern: 1.0 km point, 2.5 km point, 5.0 km point, 7.5 km point, 10 km point, every 5 km after 10 km point (15 km point, 20 km point, . . . , 35 km point, 40 km point)

Second Pattern: every 1 km until passing 10 km point after the start point, every 2 km until passing 20 km point after passing 10 km point, every 5 km until passing 40 km point after passing 20 km point After selecting the recording point pattern in step S402, the user brings the portable information terminal close to the wearable terminal 10. At this time, pairing between the portable information terminal and the wearable terminal 10 is executed, and the setting contents selected in the portable information terminal are transferred to the wearable terminal 10 and stored. By the above processing, the pre-setting processing in FIG. 7 ends.

Figure 8:
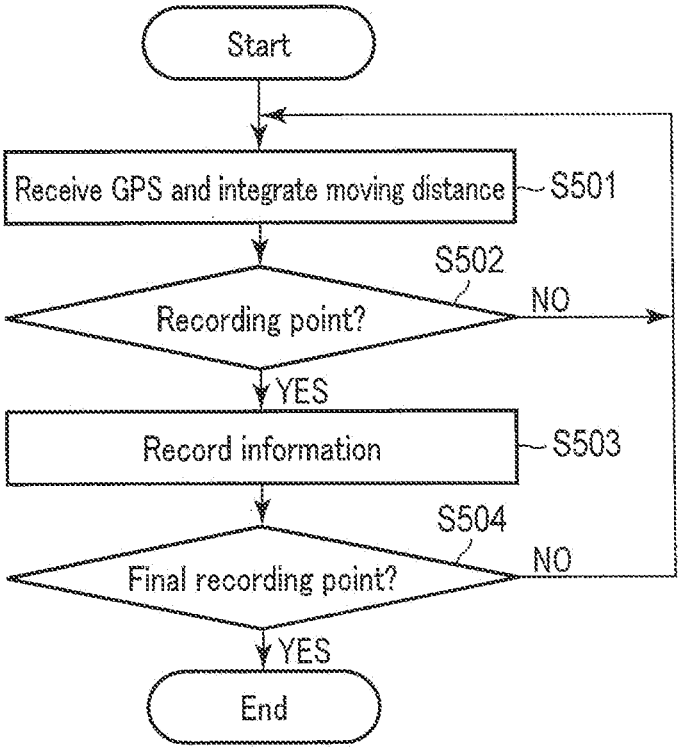
FIG. 8 is a flowchart showing the contents of recording processing of the time when passing a distance point according to the second operation example of the embodiment of the present invention.

FIG. 8 is a flowchart showing the contents of processing executed by the processor 11 after the start of recording information at the time of passing a distance point by an operation to the power key of the key operation unit 17.

At the beginning of the processing, the processor 11 obtains information of a current position by the GPS antenna 21 and the GPS receiver 15, and integrates a moving distance from a position where the operation started (step S501).

In the embodiment, as for obtaining a current position by the wearable terminal 10, the processor 11 preferentially obtains the absolute value of a current position in a situation which the absolute value of a current position can be obtained by the GPS receiver 15 and the GPS antenna 21. In an environment in which no GPS electric wave can be received, the processor 11 continues the current position obtaining operation while integrating the relative value of the current position by autonomous navigation using a combination of detection outputs of the acceleration sensor 23, gyro sensor 24, geomagnetic sensor 25, and atmospheric pressure sensor 26 until GPS electric waves can be received next, instead of information of the current position obtained from the GPS receiver 15.

Then, the processor 11 determines whether the integrated moving distance represents a preset recording point (step S502).

If the processor 11 determines that the moving distance does not represent a preset recording point (NO in step S502), it returns to the processing from step S501 and repetitively obtains the current position.

If the processor 11 determines in step S502 that the integrated moving distance represents a preset recording point (YES in step S502), it records the information obtained at that time on the memory card 20 in association with information of the distance value of the recording point (step S503).

Thereafter, the processor 11 determines whether an immediately preceding recording point is a final recording point among the set recording points (step S504).

If the processor 11 determines that an immediately preceding recording point is not a final recording point (NO in step S504), the next recording point remains, so the processor 11 returns to the processing from step S501 to continue the operation at this recording point.

The processor 11 repetitively executes the processes in steps S501 to S504 in accordance with the number of preset recording points.

If the processor 11 determines in step S504 that an immediately preceding recording point is a final recording point (YES in step S504), it determines that pieces of information at all the set recording points have been obtained, and ends the processing in FIG. 8.

If the user brings, close to the wearable terminal 10, the portable information terminal such as a smartphone in which the application program dedicated to the wearable terminal 10 is installed in advance, pairing processing through the near distance communication unit 16 and the antenna 22 is automatically executed, and pieces of information at respective recording points recorded on the memory card 20 are collected and automatically transferred to the portable information terminal at once.

As described above, according to the second operation example of the embodiment, for example, pieces of information are obtained from the start of the operation at distance points set by the user as necessary. Even if a capacity-limited power supply is used, information the user wants can be properly recorded while reducing the power consumption.

In addition, according to the embodiment, the user selects the distance of an entire course of running, and selects a pattern of points at which information corresponding to the selected distance of the entire course is recorded. Necessary setting can be easily executed without a lot of trouble to the user.

Note that it is not always necessary in the embodiment that the user selects the distance of an entire course of running and selects a pattern of points at which information corresponding to the selected distance of the entire course is recorded. It may be simply controlled using an obtained elapsed time or passing distance to, as the lapse of time from the start of movement or the distance passing from the start point of movement increases, decrease the frequency of obtainment at which index information is obtained at the start of movement or from the start point of movement.

Although not described in this operation example, if a distance to the next recording point after obtaining and recording information at a recording point is long, an intermittent operation may be set to temporarily stop the obtaining operation of a current position by the GPS antenna 21 and the GPS receiver 15 or the obtaining operation of sensor data of various sensors. This can further reduce power consumption.

In the embodiment, detection outputs of the acceleration sensor 23, gyro sensor 24, geomagnetic sensor 25, and atmospheric pressure sensor 26 are saved together with information of a current position at a recording point. A poor running form of the user or the like at each recording point can be verified later.

Although not described in the embodiment, the amount of information recorded and saved on the memory card 20 can be further reduced by adding a function capable of selecting and setting only a type of sensor the user needs from a plurality of types of sensors for detecting an external force applied to the wearable terminal 10.

In the embodiment, the GPS antenna 21 and the GPS receiver 15 mainly obtain information of a current position. However, the present invention is not limited to this and may be applied to a system using, for example, the radio tag of an IC (Integrated Circuit) chip generically called a runner's chip.

At a timing if information is recorded, the time at this timing may be recorded together.

The present invention is not limited to the above-described embodiment, and in practicing the present invention, various changes and modifications can be made without departing from the spirit and scope of the invention. The embodiments may appropriately be combined as much as possible. In this case, an effect by the combination can be obtained. The embodiment incorporates inventions of various stages, and various inventions can be extracted by appropriately combining a plurality of constituent elements disclosed in the embodiment. For example, even if some constituent elements are omitted from all constituent elements described in the embodiment, when the problem described in SUMMARY can be solved and the effect described in SUMMARY can be obtained, an arrangement from which the constituent elements are omitted can be extracted as an invention.

The invention claimed is:

1. An information recording apparatus comprising:

a wearable terminal wearable by a user;

at least one sensor provided in the wearable terminal;

a memory; and a hardware processor which, under control of a program stored in the memory, and during movement of the user while the user is wearing the wearable terminal, is configured to execute processes comprising:

acquiring, from the at least one sensor, index information related to the movement of the user after a start point of the movement of the user;

obtaining one of (i) an elapsed time elapsed from the start point of the movement of the user and (ii) a passing distance traversed from the start point of the movement of the user;

controlling, based on the one of the elapsed time and the passing distance, to set an acquisition interval at which the index information acquired from the at least one sensor is recorded in the memory, such that a frequency decreases in accordance with an increase in the one of the elapsed time and the passing distance;

recording the index information in the memory at the frequency having been set; and counting, with an information counter, a number of the index information recorded in the memory, wherein:

the controlling comprises setting the acquisition interval to a first acquisition interval during a first time period of the elapsed time, and setting the acquisition interval to a second acquisition interval during a second time period of the elapsed time, the second acquisition interval being longer than the first acquisition interval, and the second time period being after the first time period, and the recording the index information in the memory comprises:

recording the index information acquired in the first time period in a first predetermined area of the memory, recording the index information acquired in the second time period in a second predetermined area of the memory different from the first predetermined area, and specifying, based on a value of the information counter, the first predetermined area or the second predetermined area as a recording area in the memory.

2. The information recording apparatus according to claim 1, wherein the processes further comprise:

acquiring, from the at least one sensor as a component of the index information, position information representing a current position of the wearable terminal, and recording the position information in the memory, together with information on the one of the elapsed time and the passing distance.

3. The information recording apparatus according to claim 1, wherein the processes further comprise:

acquiring, from the at least one sensor as a component of the index information, information on an external force applied to the wearable terminal, and recording the information on the external force in the memory, together with information on the one of the elapsed time and the passing distance.

4. The information recording apparatus according to claim 1, wherein the processes further comprise temporarily stopping an operation until the index information is acquired next, by using the one of the elapsed time and the passing distance.

5. The information recording apparatus according to claim 1, wherein the processes further comprise:

acquiring, from the at least one sensor, information on an external force applied to the wearable terminal, and acquiring, as a component of the index information, the information on the external force.

6. The information recording apparatus according to claim 5, wherein the processes further comprise:

acquiring, from the at least one sensor, pieces of information on a plurality of external forces applied to the wearable terminal, and selecting at least one of the pieces of information from among the plurality of pieces of information on the plurality of external forces.

7. The information recording apparatus according to claim 1, wherein the processes further comprise:

controlling to set a stepwise manner in which the frequency is to be decreased in accordance with the increase in the one of the elapsed time and the passing distance, and decreasing the frequency in accordance with the stepwise manner having been set.

8. The information recording apparatus according to claim 7, wherein the processes further comprise selecting the stepwise manner from among a plurality of setting candidates.

9. The information recording apparatus according to claim 1, wherein the first predetermined area and the second predetermined area of the memory are determined in advance according to the acquisition interval for the index information acquired from the at least one sensor.

10. The information recording apparatus according to claim 1, wherein a size of the second predetermined area of the memory is smaller than a size of the first predetermined area of the memory.

11. The information recording apparatus according to claim 2, wherein a size of the second predetermined area of the memory is smaller than a size of the first predetermined area of the memory.

12. An information recording method executed by an information recording apparatus including a wearable terminal wearable by a user, at least one sensor provided in the wearable terminal, and a memory, the method comprising, during movement of the user and while the user is wearing the wearable terminal:

acquiring, from the at least one sensor, index information related to the movement of the user after a start point of the movement of the user;

obtaining one of (i) an elapsed time elapsed from the start point of the movement of the user and (ii) a passing distance traversed from the start point of the movement of the user;

controlling, based on the one of the elapsed time and the passing distance, to set an acquisition interval at which the index information acquired from the at least one sensor is recorded in the memory, such that a frequency decreases in accordance with an increase in the one of the elapsed time and the passing distance;

recording the index information in the memory at the frequency having been set; and counting, with an information counter, a number of the index information recorded in the memory, wherein:

the controlling comprises setting the acquisition interval to a first acquisition interval during a first time period of the elapsed time, and setting the acquisition interval to a second acquisition interval during a second time period of the elapsed time, the second acquisition interval being longer than the first acquisition interval, and the second time period being after the first time period, and the recording the index information in the memory comprises:

recording the index information acquired in the first time period in a first predetermined area of the memory, recording the index information acquired in the second time period in a second predetermined area of the memory different from the first predetermined area, and specifying, based on a value of the information counter, the first predetermined area or the second predetermined area as a recording area in the memory.

13. A non-transitory recording medium having a program stored thereon, the program being executable by a hardware processor of an information recording apparatus further including a wearable terminal wearable by a user, at least one sensor provided in the wearable terminal, and a memory, and the program being executable to control the hardware processor to, during movement of the user and while the user is wearing the wearable terminal, perform processes comprising:

acquiring, from the at least one sensor, index information related to the movement of the user after a start point of the movement of the user;

obtaining one of (i) an elapsed time elapsed from the start point of the movement of the user and (ii) a passing distance traversed from the start point of the movement of the user;

controlling, based on the one of the elapsed time and the passing distance, to set an acquisition interval at which the index information acquired from the at least one sensor is recorded in the memory, such that a frequency decreases in accordance with an increase in the one of the elapsed time and the passing distance;

recording the index information in the memory at the frequency having been set; and counting, with an information counter, a number of the index information recorded in the memory, wherein:

the controlling comprises setting the acquisition interval to a first acquisition interval during a first time period of the elapsed time, and setting the acquisition interval to a second acquisition interval during a second time period of the elapsed time, the second acquisition interval being longer than the first acquisition interval, and the second time period being after the first time period, and the recording the index information in the memory comprises:

recording the index information acquired in the first time period in a first predetermined area of the memory, recording the index information acquired in the second time period in a second predetermined area of the memory different from the first predetermined area, and specifying, based on a value of the information counter, the first predetermined area or the second predetermined area as a recording area in the memory.

* * * * *